United States Patent [19]

Terzian

[11] 4,050,185

[45] Sept. 27, 1977

[54] FACIAL LIQUID EXCRETING DOLL

[75] Inventor: Rouben T. Terzian, Chicago, Ill.

[73] Assignee: Marvin Glass & Associates, Chicago, Ill.

[21] Appl. No.: 652,414

[22] Filed: Jan. 26, 1976

[51] Int. Cl.[2] ..... A63H 3/48

[52] U.S. Cl. ..... 46/135 A; 46/141

[58] Field of Search ..... 46/135 A, 164, 151, 46/141

[56] References Cited

U.S. PATENT DOCUMENTS

| | | | |
|---|---|---|---|
| 2,961,795 | 11/1960 | Baggott | 46/135 A |
| 3,789,539 | 2/1974 | Cagen | 46/135 A |

*Primary Examiner*—Louis G. Mancene
*Assistant Examiner*—Robert F. Cutting
*Attorney, Agent, or Firm*—Mason, Kolehmainen, Rathburn & Wyss

[57] ABSTRACT

A doll's head, for use in conjunction with a suitable torso, which will excrete a fluid through the eyes or other facial areas of the doll for simulating tearing, or the like. The doll head includes an exterior surface formed and contoured with human characteristics and including an interior, flexible cavity or reservoir for storing fluid. The head is formed of flexible plastic having an aperture at the mouth for filling the interior flexible reservoir. A pair of small, measured holes simulating eye tear ducts permit the fluid to flow outwardly therethrough when external forces are applied to move the head bodily backwards or rotate the head about a generally vertical axis relative to the torso. A stationary, cross arm is secured to the torso and bears against the rear wall of the flexible reservoir for applying pressure thereto when the head is moved relative to the torso. A check valve, including a movable ball, is biased behind the aperture of the mouth in fluid communication with the interior of the reservoir to permit filling of the reservoir and preventing leakage of fluid through the mouth aperture.

21 Claims, 8 Drawing Figures

FACIAL LIQUID EXCRETING DOLL

BACKGROUND OF THE INVENTION

1. Brief Description of the Invention

This invention relates to dolls and, in particular, to a tearing eye doll.

2. Description of the Prior Art

In the past, dolls have been produced which can simulate some of the functions normally associated with an actual person. These types of dolls have been well received by the public and especially by children who derive much entertainment and pleasure from playing with a life-like toy. Particularly, dolls have been produced that can simulate crying, eating, drinking, and perform other human functions associated with the head or face. However, in order to operate previous tearing dolls, it was necessary to manually depress or crush the head in order to simulate the crying effect. This is not particularly desirable since it substantially deviates from the normal treatment of children or babies by adults.

SUMMARY OF THE INVENTION

The preferred embodiment of the doll according to the present invention includes a flexible head portion formed with an interior fluid cavity or reservoir for storing a pedetermined amount of fluid. The fluid is introduced into the reservoir through a check valve in communication with an aperture formed in the mouth portion of the doll's head. A pair of measured apertures adjacent the eyes of the doll's head allow fluid from within the reservoir to pass outwardly through the apertures onto the face of the doll when the volume of the cavity is reduced. A stationary cross arm in engagement with the rear reservoir wall applies pressure to reduce the volume of the reservoir as the head is rotated slightly about a vertical or horizontal axis, relative to the torso, thereby eliminating any necessity of physically compressing the head of the doll. The check valve includes a movable ball which seats within a reduced area formed in the valve to prevent fluid from leaking through the mouth aperture out of the reservoir. In one form the doll head is molded so as to have an integral portion thereof biasing and seating the ball at the valve aperture.

DETAILED DESCRIPTION OF THE PREFERRED EMBODIMENT

Figure 1:
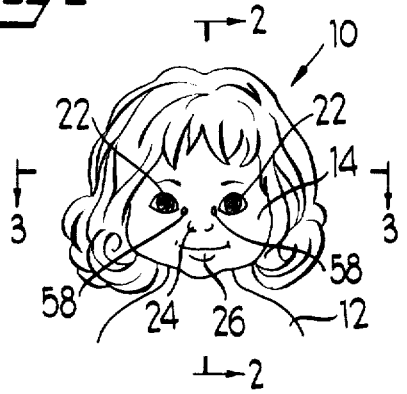
FIG. 1 is a front elevational view of the doll head of the present invention, mounted on a suitable torso.
Figure 2:
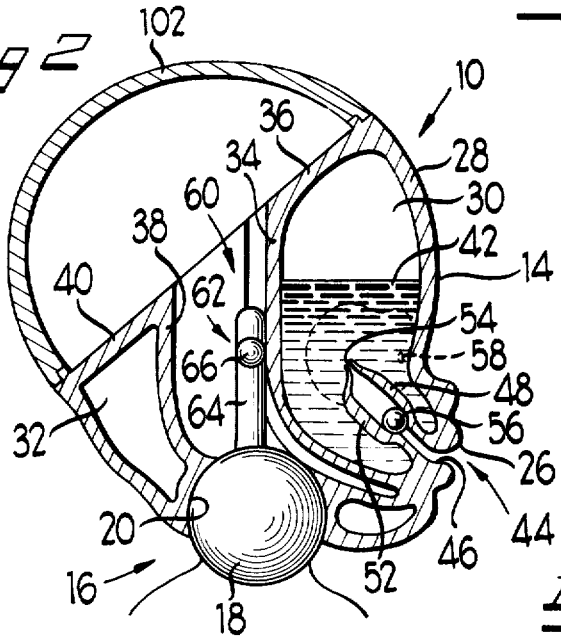
FIG. 2 is a vertical section, on a enlarged scale, taken generally along the line 2—2 of FIG. 1.
Figure 5:
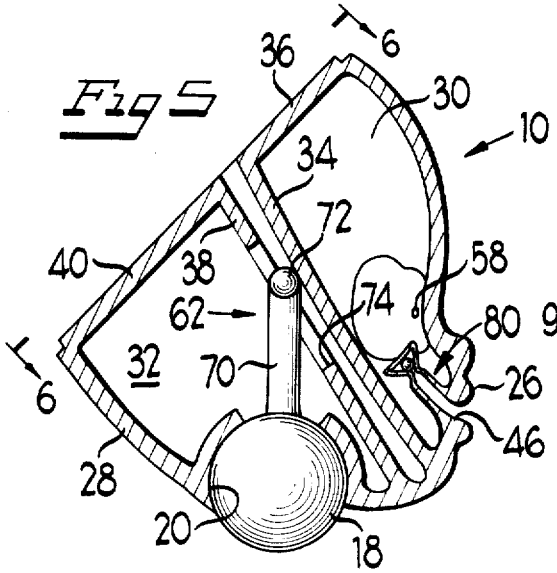
FIG. 5 is a vertical section similar to FIG. 2 showing an alternate embodiment of the doll's head of the present invention.

The doll or figure toy head, generally designated 10, of the present invention is seen mounted on an suitable torso 12 in FIGS. 1, 2 and 5. The head is formed with a face portion 14 and is pivotally mounted to the torso 12 by a neck, generally designated 16. The neck 16 includes a ball and socket joint comprising a sphere 18 fixedly secured to the torso and a socket-type aperture 20 formed in the doll's head for universally receiving the sphere. The face includes a pair of eyes 22, a nose 24 and a mouth 26.

The head 10 comprises an outer shell 28 which is manufactured with two closed interior cavities, a front cavity 30 and a rear cavity 32. The front cavity 30 is defined by the face 14, a flexible unitarily molded interior wall 34 and a top wall 36. The rear cavity 32 is defined by the rear wall of the shell 28, a flexible, unitarily molded interior wall 38 and a top wall 40. The front cavity 30 is adjacent the face portion 14 and extends upwardly behind the forehead of the doll to form a fluid reservoir between the face 14 and the interior wall 34. The reservoir is adapted to be filled with a suitable fluid 42, such as water or the like, through an inlet means, generally designated 44. The inlet means includes an aperture 46 provided in the mouth 26 and a check valve 48 in fluid communication with the reservoir 30 and the aperture 46. The check valve includes a canted cylindrical body portion 52 having a flap valve or slit 54 at its interior end. A weighted ball 56 such as a steel ball or the like, is inserted within the cylindrical portion 52 and seats by gravity against the lowermost end, adjacent the aperture 46, to prevent fluid passing therethrough out of the aperture 46. A reservoir filling device (not shown) is conventional and includes a syringe portion and a needle portion which is inserted through the aperture 46 to move the ball 56 and thus permit the introduction of the fluid 42 into the cavity 30 by compressing the syringe portion. Removal of the reservoir filling device permits the ball 56 to reseat against the aperture 46 to thereby seal the cavity 30.

A pair of measured orifices 58, on either side of the nose 24 adjacent the eyes 22, communicate with the interior cavity 30 and permit the fluid 42 therein to be forced outwardly when the volume of the reservoir 30 is reduced. It is preferable that the size of the orifices 58 be regulated during the manufacture of punching thereof so as to prevent unintended leakage of the fluid. The orifices 58 preferably are of a size small enough so that the surface tension of the water or other fluid across each orifice 58 will not allow water to inadvertently leak out of the cavity. However, the orifices should not be so small as to cause or permit capillary action along their length which could cause some of the fluid to leak out.

Figure 3:
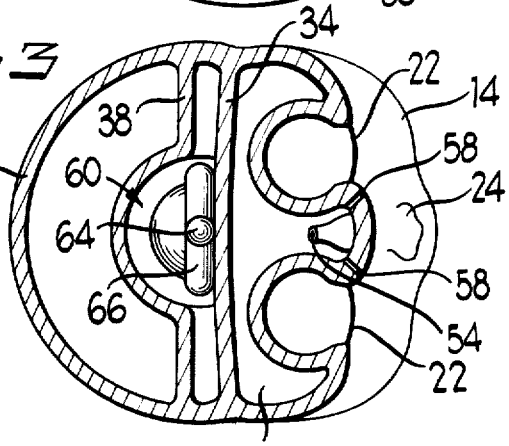
FIG. 3 is a horizontal section, on an enlarged scale, taken generally along the line 3—3 of FIG. 1.
Figure 4:
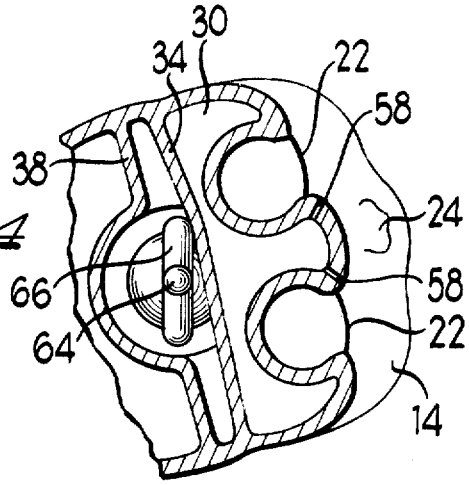
FIG. 4 is a fragmented, horizontal section, similar to FIG. 3, showing the operation and movement of the doll's head which, through pressure, reduces the volume of the interior reservoir.

With references to FIGS. 2, 3 and 4, an intermediate, internal open cavity, generally designated 60, is defined by the two interior walls 34 and 38. An elongated pressure arm, generally designated 62, is provided to exert pressure against the rear wall of the front cavity 30 to force the fluid through the orifices 58. The elongated arm comprises an upstanding vertical post 64 and a horizontal cross bar 66 secured thereto which is mounted securely to the ball 18 of the neck 16. The cross bar 66 is generally parallel with the face of the doll as shown in FIG. 3 and, therefore, when the head 10 of the doll is rotated in either direction about a generally vertical axis, on its neck mounting 16, one of the ends of the cross bar 66 will apply pressure to and deform the interior wall 34 thus reducing the volume of the reservoir 30 causing fluid 42 therein to be expelled through the orifices 58, as seen in FIG. 4. When the head 10 of the doll is rotated about a horizontal axis the top of the post 64 and the cross bar deform the interior wall 34 causing fluid to flow through the orifices 58.

An alternate embodiment of the doll head 10 of the present invention is shown in FIG. 5, and like numerals between the respective figures (FIGS. 5 and 2) are used to identify similar elements. The shape of the interior cavities 30 and 32 are slightly different than is previously described because of the different angular relationship between the internal walls 34 and 38. However, the remaining elements remain substantially unchanged. In the alternate embodiment of FIG. 5, the elongated pressure arm, generally designated 62, includes a pair of transversely spaced, upstanding posts 70 secured to the ball 18 and a horizontal, connecting member 72 between the top ends thereof. The elongated arm 62, in this case, passes through a generally ovoid aperture 74 provided in the rear interior wall 38 and engages the front interior wall 34, as above. In this alternate embodiment, the generally upside down U-shaped pressure arm 62 will apply pressure to and deform the front interior wall 34 as the head 10 is pivoted about a generally vertical axis or a generally transverse, horizontal axis through the ball 18 of of the neck joint 16. As the head 10 is twisted or pivoted backwards, the doll will appear to cry as fluid 42 exits through the orifices 58.

Figure 6:
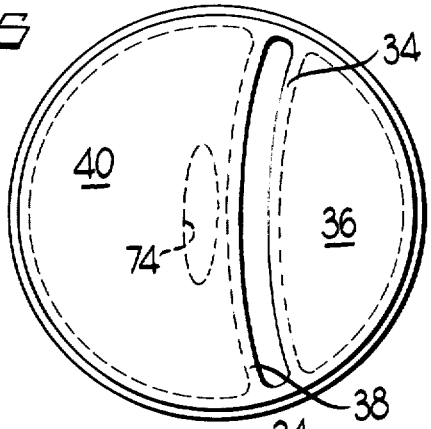
FIG. 6 is a top perspective view of the head of the alternate embodiment of FIG. 5 taken generally along the line 6—6 of FIG. 5.

In both of the embodiments (FIGS. 2 and 5) the outer shell 28 and the walls forming the face 14 are of substantially greater thickness than the flexible walls 34 defining the rear wall of the cavity 30. The flexible wall 34 may also be bowed away from the face as shown in FIG. 6. These provisions prevent the face 14 of the doll from becoming distorted as the head 10 is manually moved to the tearing position whereat the wall 34 is deformed.

Figure 7:
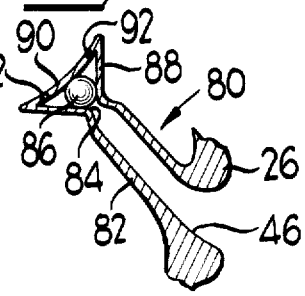
FIG. 7 is an enlarged, vertical section of the check valve as shown in FIG. 5.
Figure 8:
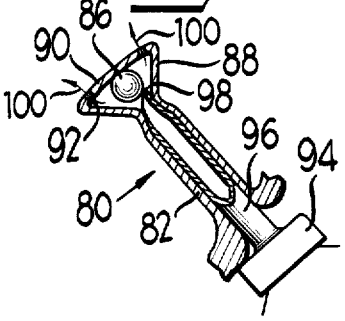
FIG. 8 is a fragmented vertical section, similar to FIG. 7 showing the operation of the check valve, including a nozzle introduced into the mouth portion.

An alternate embodiment of the inlet check valve 48 is shown in FIGS. 7 and 8, generally designated 80. The alternate check valve 80 includes a canted cylindrical chamber 82 in communication with the aperture 46 formed in the mouth 26 of the doll head. The inner end of the cylindrical chamber 82 terminates in a reduced cross sectional end which defines a seat 84 for a valve ball 86. A frusto-conical diverging portion 88 is integrally molded with and in communication with the inner end of the cylindrical chamber 82 and includes a flexible, concave disc portion 90 which closes the end of the valve 80. The disc portion includes a plurality of apertures 92 and in its normal, unbiased state, engages the ball 86 forcing the ball against the seat 84 to prevent water from seeping out through the aperture 46.

The reservoir 30 is filled with fluid, as shown in FIG. 8, by using a reservoir filling device 94. The reservoir filling device 94 includes a tubular shaped, elongated nozzle portion 96 which is provided with an angled cut end 98 so that upon insertion, the end 98 engages the ball 86 pushing it away from its seat 84 so that, as the filling device is pressurized, the fluid 42 will pass through the valve and around the ball 86 through the apertures 92 as shown by the wavy arrows 100.

When the nipple 96 is removed from the aperture 46, the ball 86 will again seat itself under the biasing force of the integrally molded disc 90 and prevent seepage of the fluid out of the aperture 46. Thus, no extraneous biasing means need be provided.

Therefore, it can be seen from the above description, that the tearing doll of the present invention can be made to simulate tears either by rotating the head about a generally vertical axis or by pivoting the head about a generally horizontal axis.

The two embodiments shown (FIGS. 2 and 5) are provided with generally flat top walls 36 and 40 so that a cap or domeshaped portion 102 can be easily secured thereto. This arrangement permits various means to be utilized for attaching hair to the cap portion 102 without interfering with the operation of the reservoir 30. Additionally, two types of check valves 48 and 80 are shown which prevent the leakage of fluid 42 out of the mouth 46 of the doll's head 10, the valve 80 being integrally molded with the doll head.

The foregoing detailed description has been given for clearness of understanding only and no unnecessary limitations should be understood therefrom as some modifications will be obvious to those skilled in the art.

It is claimed:

1. A tearing eye doll comprising:

a torso;

a unitarily molded head portion, said head including a flexible shell with a face on the front side thereof;

a unitarily molded interior wall spanning a portion of said shell and forming a liquid reservoir generally behind the face of the doll head;

deforming means secured to said torso for movably mounting the head thereon, said deforming means having a portion thereof extending into engagement with the interior wall for deforming said interior wall in response to movement of the head relative to the torso to reduce the volume of the reservoir;

inlet means formed in said head, in communication with said liquid reservoir, for introducing fluid into the reservoir; and a plurality of apertures through said flexible shell generally in the facial area of the doll for the passage therethrough of liquid from the reservoir to simulate tearing.

2. The tearing eye doll of claim 1 wherein said interior wall spanning said shell is curved, being bowed away from said facial portion of the head to permit compression thereof without distorting the face of the doll head.

3. The tearing eye doll of claim 1 wherein said deforming means includes mounting means for pivotally mounting the head to the torso and said portion includes an upwardly extending member rigidly secured to the torso in a position for engagement with the rearward side of said interior wall so that movement of the head relative to the torso about said pivotal mounting means applies pressure to said reservoir to force at least a portion of said fluid therein through said apertures.

4. The tearing eye doll of claim 3 wherein said pivotal mounting means comprises a ball and socket joint wherein the ball is disposed on the uppermost part of the torso and the socket is provided on the lowermost part of said head.

5. The tearing eye doll of claim 4 wherein said upwardly extending member is secured to the top of said ball.

6. The tearing eye doll of claim 3 wherein said upwardly extending member has a generally horizontal transverse cross bar secured thereto in engagement with the rearward surface of said interior wall so that rotation of said head about either a horizontal or vertical axis causes the cross bar to flex the interior wall of said reservoir and thus decrease the volume of the reservoir.

7. The tearing eye doll of claim 3 wherein said upwardly extending member comprises a pair of upstanding posts and a generally horizontal cross bar therebetween to define a U-shaped member, the cross bar being engageable with the rearward surface of said interior wall whereby pivotal movement of said head about either a vertical or horizontal axis defined by said universal mounting means causes flexing of said interior wall to reduce the volume of said fluid reservoir.

8. The tearing eye doll of claim 7 wherein said mounting means comprises a ball and socket joint and said extending member is mounted on the top of said ball portion.

9. The tearing eye doll of claim 3 wherein said pivotal mounting means comprises a ball and socket joint wherein the ball is disposed on the uppermost part of the torso and the socket is provided on the lowermost part of said head.

10. The tearing eye doll of claim 9 wherein said upwardly extending member is secured to the top of said ball.

11. The tearing eye doll of claim 1 wherein the interior wall is formed of substantially thinner flexible material relative to the thickness of the walls of the flexible plastic shell.

12. The tearing eye doll of claim 1 wherein said inlet means comprises a one-way type check valve in communication with the reservoir and an aperture formed in the mouth of the face of the doll.

13. The tearing eye doll of claim 12 wherein said check valve includes an internal canted cavity adjacent the aperture formed in the mouth, and a freely movable ball within the cavity for seating, due to the influence of gravity, at the lower end of the cavity against the aperture to prevent the passing of liquid from the reservoir through the aperture.

14. The tearing eye doll of claim 12 wherein said check valve comprises a cavity in communication with the aperture formed in the mouth of the doll, an inward reduced end of said cylindrical cavity about the aperture, a frusto-conical flared wall about said inward reduced end, and a ball within said frusto-conical section for seating in said reduced area to prohibit the passage of liquid from the reservoir to the aperture formed in the mouth.

15. The tearing eye doll of claim 14 including a flexible wall portion of said cavity opposite said reduced end for biasing the ball into engagement with said aperture.

16. The tearing eye doll of claim 15 in combination with a nozzle, said nozzle being adapted for introduction into said cavity to engage said ball and move the ball, against the biasing force of said flexible wall to permit the introduction of a fluid past said ball into the reservoir, said nozzle having a canted apertured end engageable with the ball whereby the canted configuration prevents the ball from closing the aperture.

17. A check valve means for utilization with molded doll parts, or the like, which have interior cavities for the introduction thereinto of a liquid, said check valve means comprising:

an aperture exposed on the exterior of the doll part in communication with the interior of said cavity;

a valve seat formed about said aperture;

a valve ball positionable against said valve seat; and a flexible wall molded integrally with said doll part and engageable with said ball to bias the ball against said valve seat whereby the ball can be moved away from the valve seat by an appropriate liquid filling instrument against the flexing of said flexible wall for filling said cavity with an appropriate liquid.

18. The check valve means of claim 17 wherein said valve seat comprises a frusto-conical wall flaring inwardly away from said aperture and molded integrally with said valve part and said flexible wall is molded integrally with said frusto-conical wall.

19. The check valve means of claim 18 wherein said flexible wall has at least one aperture therein for the passage therethrough of fluid into said cavity.

20. A liquid excreting doll, comprising:

a molded doll head comprising a shell with a face defining the front side thereof;

an interior flexible wall forming a cavity behind the face of the doll head for the introduction thereinto of an appropriate liquid;

a doll torso to which said doll head is mounted on the top thereof for movement relative thereto;

a pressure exerting means fixed to said doll torso and extending into said doll head behind said cavity for engaging said flexible wall and decreasing the volume of said cavity in response to movement of the doll head relative to the torso to bias said flexible wall against said pressure exerting member; and at least one aperture in said doll head in communication with said cavity through which said liquid may pass as said pressure exerting member flexes said interior wall.

21. The doll of claim 20 wherein said pressure exerting member comprises a ball fixed to said doll torso providing a universal joint about which said doll head is movable relative to said torso, and including an upwardly directed member fixed to said ball forming the pressure exerting means engageable with the flexible wall of said cavity.

* * * * *